US006361040B1

(12) United States Patent
Itakura

(10) Patent No.: US 6,361,040 B1
(45) Date of Patent: Mar. 26, 2002

(54) ERRONEOUS CONTAINER INSERTION PREVENTION STRUCTURE AND CONTAINER PROCESSING APPARATUS

(75) Inventor: Toru Itakura, Isehara (JP)

(73) Assignee: Fuji Photo Film Co. Ltd., Kanagawa-Ken (JP)

( * ) Notice: Subject to any disclaimer, the term of this patent is extended or adjusted under 35 U.S.C. 154(b) by 0 days.

(21) Appl. No.: 09/541,062

(22) Filed: Mar. 31, 2000

(30) Foreign Application Priority Data

Mar. 31, 1999 (JP) ..... 11-093675

(51) Int. Cl.[7] ..... B65H 1/04
(52) U.S. Cl. ..... 271/164; 271/162
(58) Field of Search ..... 271/241, 162, 271/164, 145; 399/393; 378/182–188

(56) References Cited

U.S. PATENT DOCUMENTS 4,098,501 A * 7/1978 Tani et al. ..... 271/164
4,494,746 A * 1/1985 Moser ..... 271/164
4,535,981 A * 8/1985 Watanabe et al. ..... 271/164
5,100,123 A * 3/1992 Kagiura et al. ..... 271/164
5,379,997 A * 1/1995 Ohta ..... 378/188

* cited by examiner

*Primary Examiner*—Christopher P. Ellis
*Assistant Examiner*—Mark A. Deuble
(74) *Attorney, Agent, or Firm*—Sughrue Mion, PLLC

(57) ABSTRACT

An erroneous container insertion prevention structure has a stopper mechanism disposed upstream of a positioning ledge for positioning the leading end of a cassette on a support base, for preventing the cassette from being inserted, and a releasing mechanism disposed at a container insertion reference position, for engaging the cassette to retract the stopper mechanism out of the path of said cassette only when the cassette is inserted along the container insertion reference position. The erroneous container insertion prevention structure, which is relatively simple in arrangement, allows the cassette to be reliably loaded into a cassette loading unit in a desired attitude.

12 Claims, 8 Drawing Sheets

ERRONEOUS CONTAINER INSERTION PREVENTION STRUCTURE AND CONTAINER PROCESSING APPARATUS

BACKGROUND OF THE INVENTION

1. Field of the Invention

The present invention relates to a structure for preventing a container which stores a sheet-like member from being removably inserted in error into a loading unit, and a container processing apparatus for preventing such a container from being inserted in error into a loading unit and also from physically interfering with an internal mechanism.

2. Description of the Related Art

There is known a system for recording radiation image information of a subject such as a human body with a stimulable phosphor, and reproducing the recorded radiation image information on a photosensitive medium such as a photographic film, or displaying the recorded radiation image information on a display device such as a CRT or the like.

When a radiation energy such as X-rays, α-rays, γ-rays, electron beams, ultraviolet radiation, or the like is applied to a certain phosphor, it stores part of the applied radiation energy. When stimulating light such as visible light is subsequently applied to the phosphor, the phosphor emits light depending on the stored radiation energy. Such a phosphor is referred to as a stimulable phosphor. A stimulable phosphor is usually used in the form of a sheet which is referred to as a stimulable phosphor sheet.

The above known system includes an image information reading apparatus which comprises a reading unit for reading image information recorded on a stimulable phosphor sheet, and an erasing unit for erasing remaining image information from the stimulable phosphor sheet after the recorded image information has been read. In the image information reading apparatus, a cassette housing a stimulable phosphor sheet which bears radiation image information of a subject recorded by an external exposure device is inserted into a loading unit.

Thereafter, the lid of the cassette is opened, and then the stimulable phosphor sheet is taken out of the cassette by a sheet feeding mechanism (sheet feeder). The stimulable phosphor sheet is delivered to the reading unit by a sheet delivering mechanism. In the reading unit, the recorded image information is read from the stimulable phosphor sheet, and then remaining image information is erased from the stimulable phosphor sheet in the erasing unit, after which the stimulable phosphor sheet is placed into the cassette which has been disposed in the loading unit.

The above system also includes an image information reproducing apparatus for reproducing radiation image information on a photographic photosensitive medium such as a photographic film or the like. After a magazine which contains a plurality of photographic photosensitive mediums is loaded into a loading unit, one of the photographic photosensitive mediums at a time is removed from the magazine and delivered to a sheet feeding mechanism (sheet feeder), which feeds the photographic photosensitive medium to a recording unit. In the recording unit, the radiation image information obtained from the stimulable phosphor sheet is recorded on the photographic photosensitive medium by the application of a laser beam or the like.

In the image information reading apparatus or the image information reproducing apparatus, the cassette or magazine (hereinafter referred to as "container") is manually loaded into the loading section by the user. The loading unit has an insertion reference position aligned with one side of a loaded container so that a plurality of containers of different dimensions can be loaded into the loading unit. The user manually inserts a selected container along the insertion reference position into the loading unit.

However, the user may possibly recognize the insertion reference position in error or insert the container obliquely into the loading unit, with the result that the container may not be loaded into the loading unit in proper conditions. When the container is not properly loaded into the loading unit, the container may physically interfere with an internal mechanism, possibly resulting in a failure for a stimulable phosphor sheet to be fed from the container or causing damage to the sheet feeding mechanism.

SUMMARY OF THE INVENTION

It is a general object of the present invention to provide a structure of simple arrangement for reliably preventing a container from being inserted in error into a loading unit.

A major object of the present invention is to provide a container processing apparatus of simple arrangement for reliably preventing a container from being inserted in error into a loading unit and physically interfering with an internal mechanism.

The above and other objects, features, and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
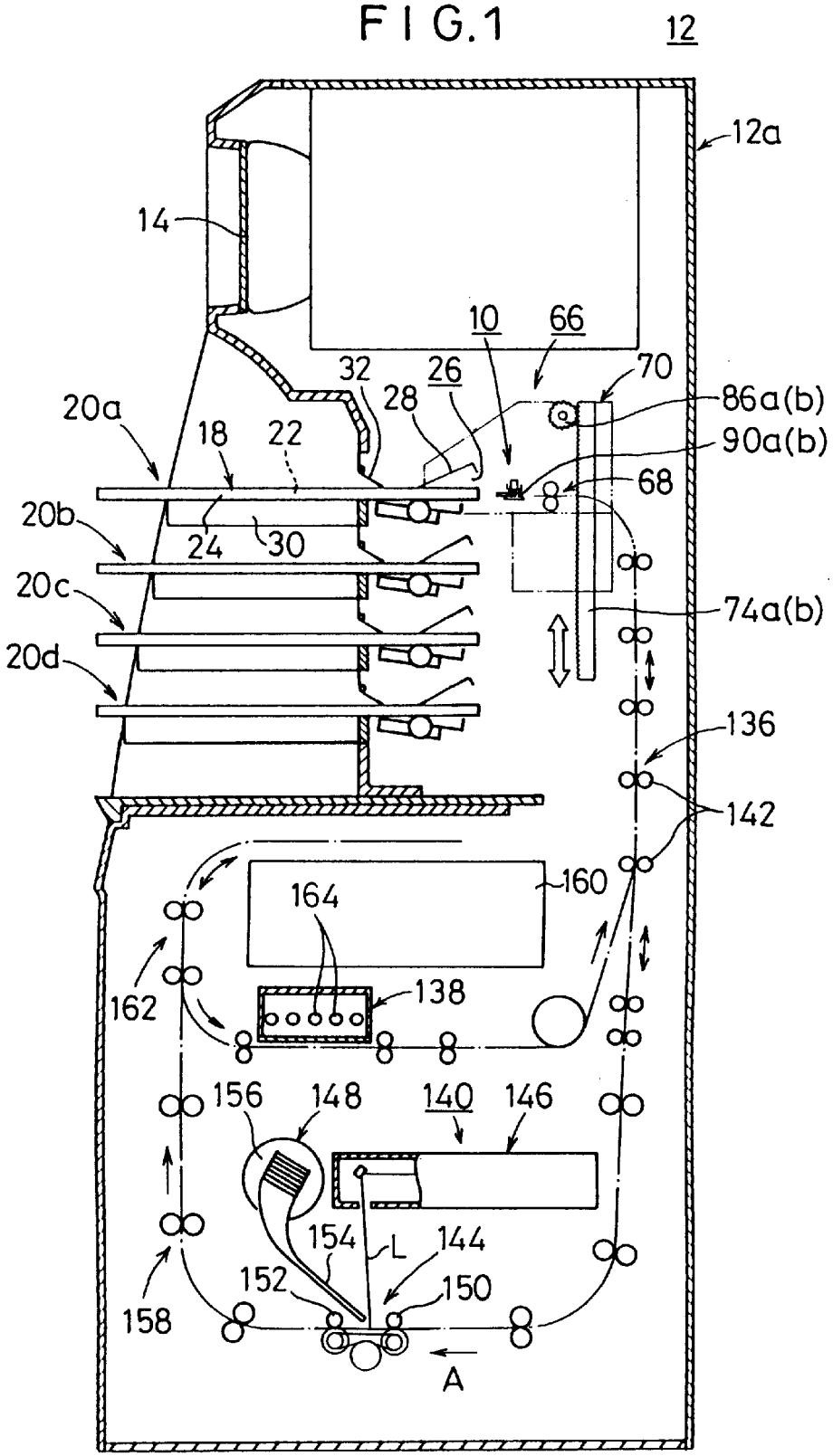
FIG. 1 is a schematic vertical cross-sectional view of an image information reading apparatus which incorporates an erroneous container insertion prevention structure according to a first embodiment of the present invention.

FIG. 1 shows in schematic vertical cross section an image information reading apparatus (container processing apparatus) 12 which incorporates an erroneous container insertion prevention structure 10 according to a first embodiment of the present invention.

The image information reading apparatus 12 has an apparatus housing 12*a* including a front wall (control wall) which supports on its upper portion a touch panel 14 that functions as controls and a display monitor. The apparatus housing 12*a* accommodates therein a plurality of, e.g., four, cassette loading regions 20*a* through 20*d* for removably holding respective cassettes (containers) 18, disposed below the touch panel 14.

As shown in FIG. 1, each of the cassettes 18 comprises a casing 24 for housing a stimulable phosphor sheet (sheet-like member) 22, and a lid 28 by which an opening 26 in the casing 24 is openably closed.

The cassette 18 has a lock means (not shown) for locking the lid 28 in a closed position on the casing 24.

Figure 2:
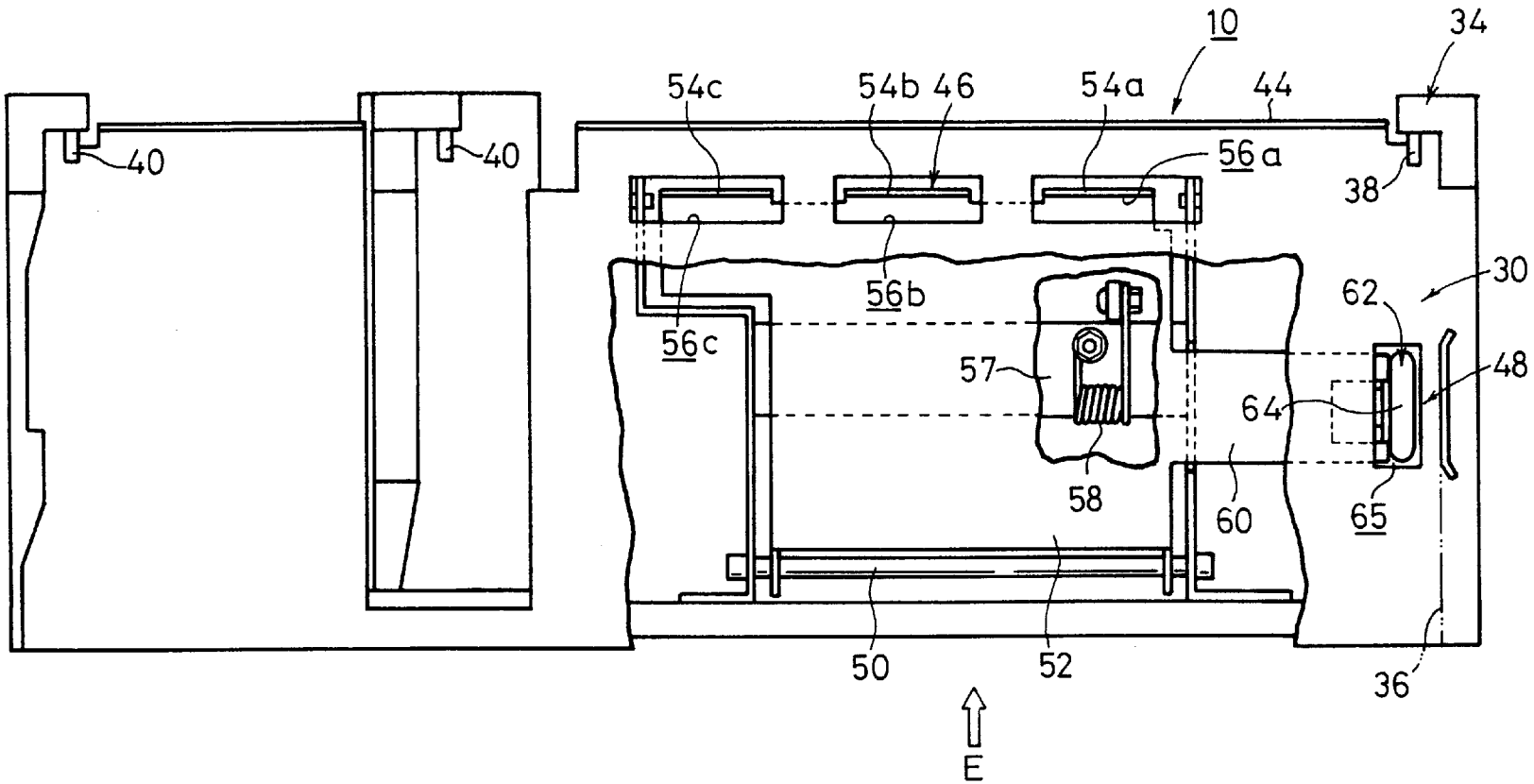
FIG. 2 is a plan view of the erroneous container insertion prevention structure.

Each of the cassette loading regions 20*a* through 20*d* has a support base 30 for placing the cassette 18 thereon and a shutter 32 openably and closably disposed for blocking light against entry into the apparatus housing 12*a*. Each of the cassette loading regions 20*a* through 20*d* incorporates a cassette unlocking mechanism 34 (see FIG. 2) for unlocking cassettes 18 of different dimensions that have been loaded. Stimulable phosphor sheets 22 that can be used in the image information reading apparatus 12 have different sizes, i.e., a metric size, an inch size, a mammographic size, etc., and hence cassettes 18 for storing these stimulable phosphor sheets 22 also have corresponding different dimensions. As shown in FIG. 2, the cassette unlocking mechanism 34 comprises a reference unlock pin 38 disposed at a cassette insertion reference position 36, and a plurality of unlock pins 40 disposed in positions corresponding to the cassettes 18 of different dimensions.

Figure 3:
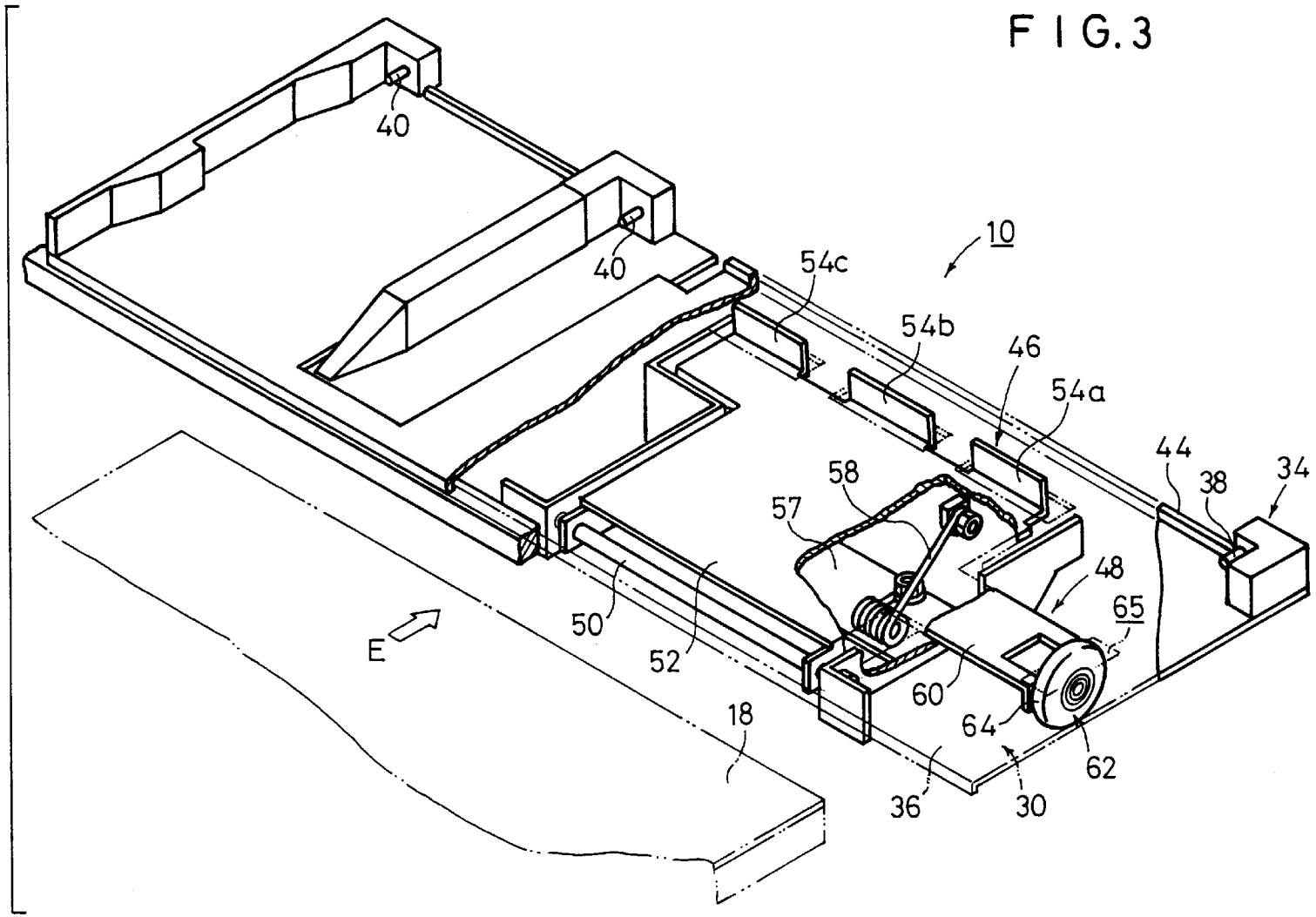
FIG. 3 is a perspective view of the erroneous container insertion prevention structure.

As shown in FIGS. 2 and 3, the support base 30 incorporates the erroneous cassette insertion prevention structure 10 for preventing the cassette 18 from being inserted in error when the cassette 18 is removably loaded into each of the cassette loading regions 20*a* through 20*d*. The erroneous cassette insertion prevention structure 10 comprises a stopper means 46 for engaging the leading end of the cassette 18 to block the cassette 18 against further entry, the stopper means 46 being disposed upstream, with respect to the direction indicated by the arrow E in which the cassette 18 is inserted, of a positioning ledge 44 at a position on the support base 30 for positioning the leading end of the cassette 18, and a releasing means 48 disposed at the cassette insertion reference position 36, for engaging the cassette 18 and retracting the stopper means 46 out of the path of the cassette 18 only when the cassette 18 enters along the cassette insertion reference position 36. The stopper means 46 has a swing member 52 swingably mounted on the reverse side of the support base 30 by a shaft 50 which is connected to a proximal end of the swing member 52. The swing member 52 has a plurality of, e.g., three, engaging fingers 54*a*–54*c* integrally formed with and bent upwardly from a distal end of the swing member 52. When the swing member 52 swings, the engaging fingers 54*a*–54*c* move through respective openings 56*a*–56*c* defined in the support base 30 into and out of the path of the cassette 18 on the support base 30. A spring 58 acts between the lower surface of the swing member 52 and a fixed plate 57 for normally biasing the swing member 52 toward the support base 30 to position the engaging fingers 54*a*–54*c* through the respective openings 56*a*–56*c* in the path of the cassette 18.

The releasing means 48 has a circular cam 62 supported on the swing member 52 by a joint plate 60. The cam 62 has an arcuate surface 64 on at least its upper portion which is contacted by the cassette 18. The cam 62 can be displaced from the reverse side of the support base 30 through an opening 65 defined in the support base 30 into the path of the cassette 18 on the support base 30.

A vertical sheet feeder 66 is vertically movably disposed behind the cassette loading units 20*a* through 20*d*. The vertical sheet feeder 66 can selectively be aligned with any one of the cassette loading units 20*a* through 20*d* for removing a stimulable phosphor sheet 22 from the cassette 18 in the corresponding one of the cassette loading units 20*a* through 20*d* and returning a stimulable phosphor sheet 22 from which radiation image information is read and erased back into the cassette 18.

Figure 4:
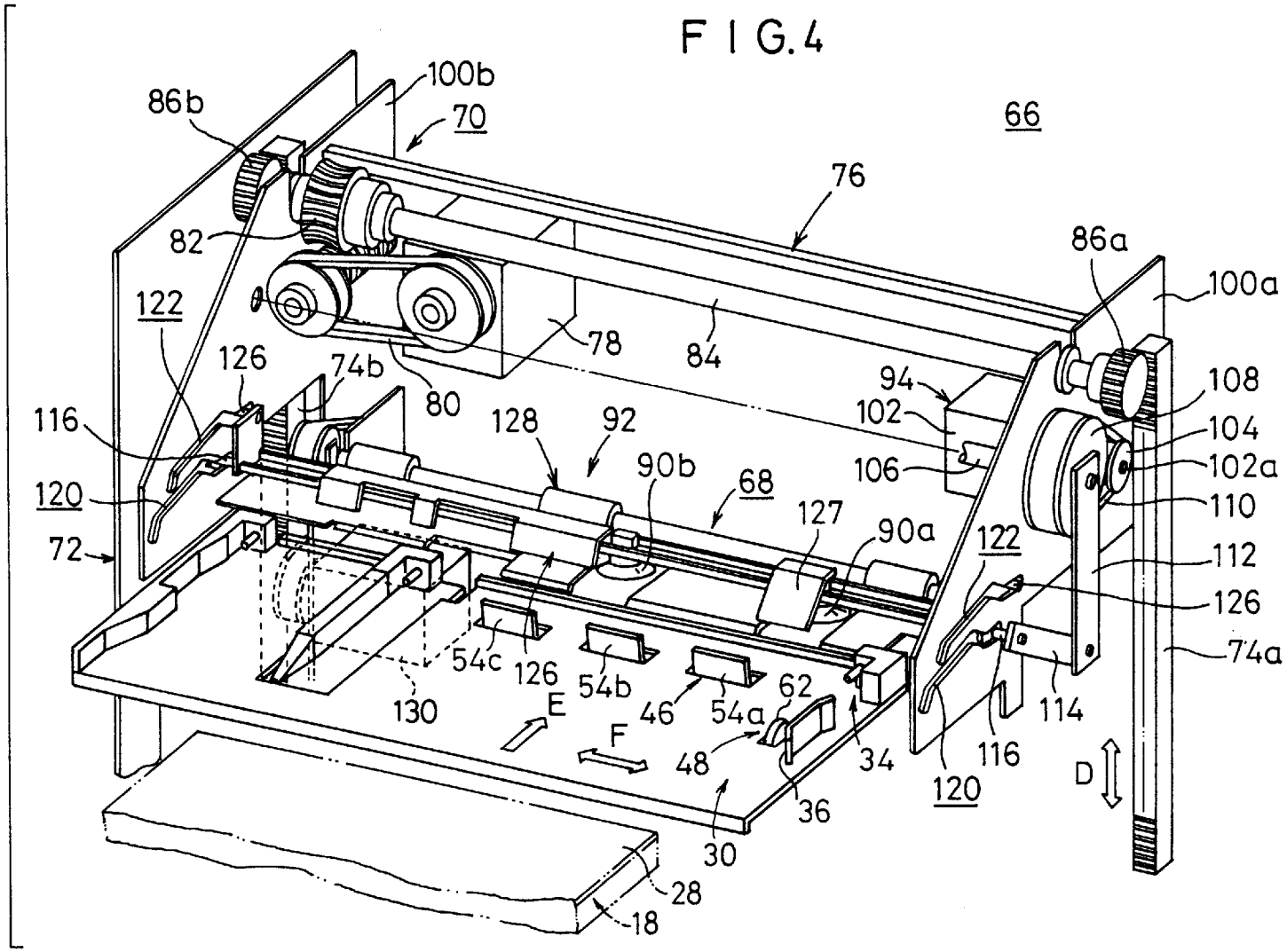
FIG. 4 is a fragmentary perspective view of a vertical sheet feeder of the image information reading apparatus.

As shown in FIG. 4, the vertical sheet feeder 66 comprises a sheet feeding mechanism 68 and a lifting and lowering mechanism 70 for vertically moving the sheet feeding mechanism 68 in the vertical directions indicated by the arrow D. The lifting and lowering mechanism 70 has a fixed frame 72 with a pair of vertical racks 74*a*, 74*b* fixed thereto. The lifting and lowering mechanism 70 also has a vertically movable frame 76 to which a motor 78 is fixed. The motor 78 is operatively coupled to a gear assembly 82 by a belt and pulley means 80. The gear assembly 82 serves to transmit rotational forces from the motor 78 to a rotatable shaft 84 which supports on its opposite ends respective pinions 86*a*, 86*b* held in mesh with the respective racks 74*a*, 74*b* for holding the vertically movable frame 76 in a vertical position. The sheet feeding mechanism 68 is incorporated in the vertically movable frame 76.

The sheet feeding mechanism 68 has a pair of suction cups 90*a*, 90*b* movable into the cassette 18 with the lid 28 being open in one of the cassette loading units 20*a* through 20*d*, and a moving means 94 for moving the suction cups 90*a*, 90*b* between the cassette 18 and a feeding means 92 for delivering the stimulable phosphor sheet 22 out of the cassette 18 to the feeding means 92 in the direction indicated by the arrow E.

Figure 5:
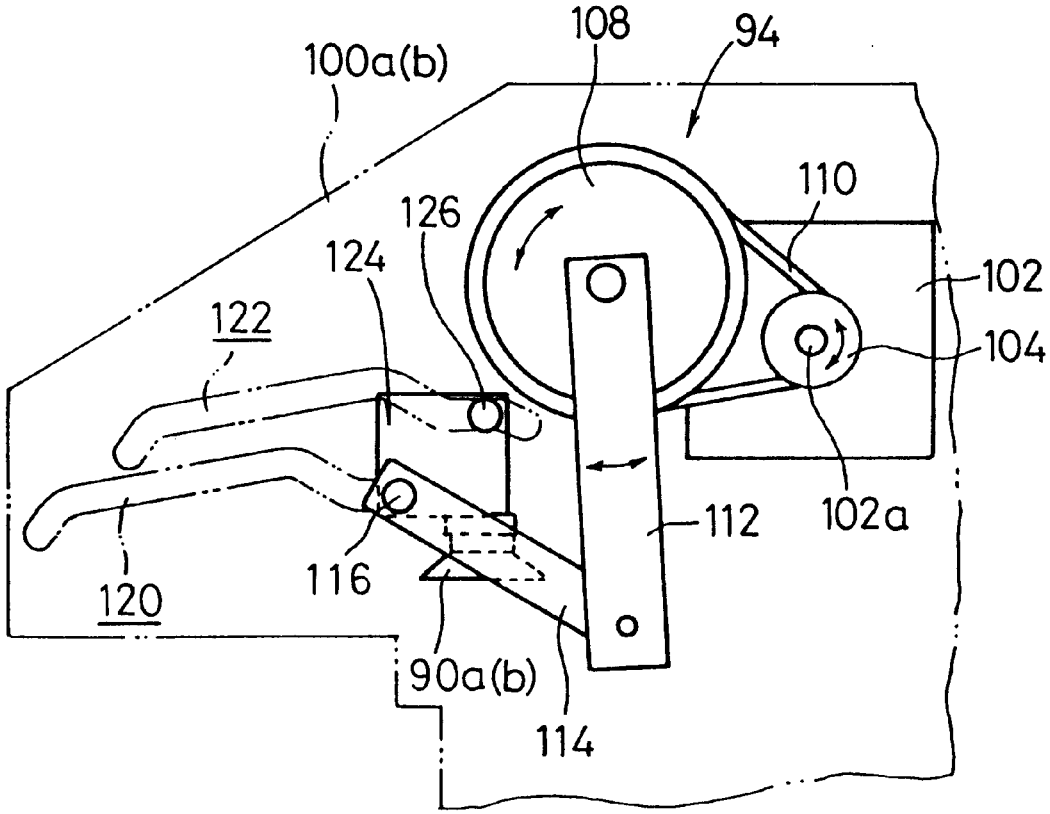
FIG. 5 is a fragmentary side elevational view of the vertical sheet feeder.
Figure 6:
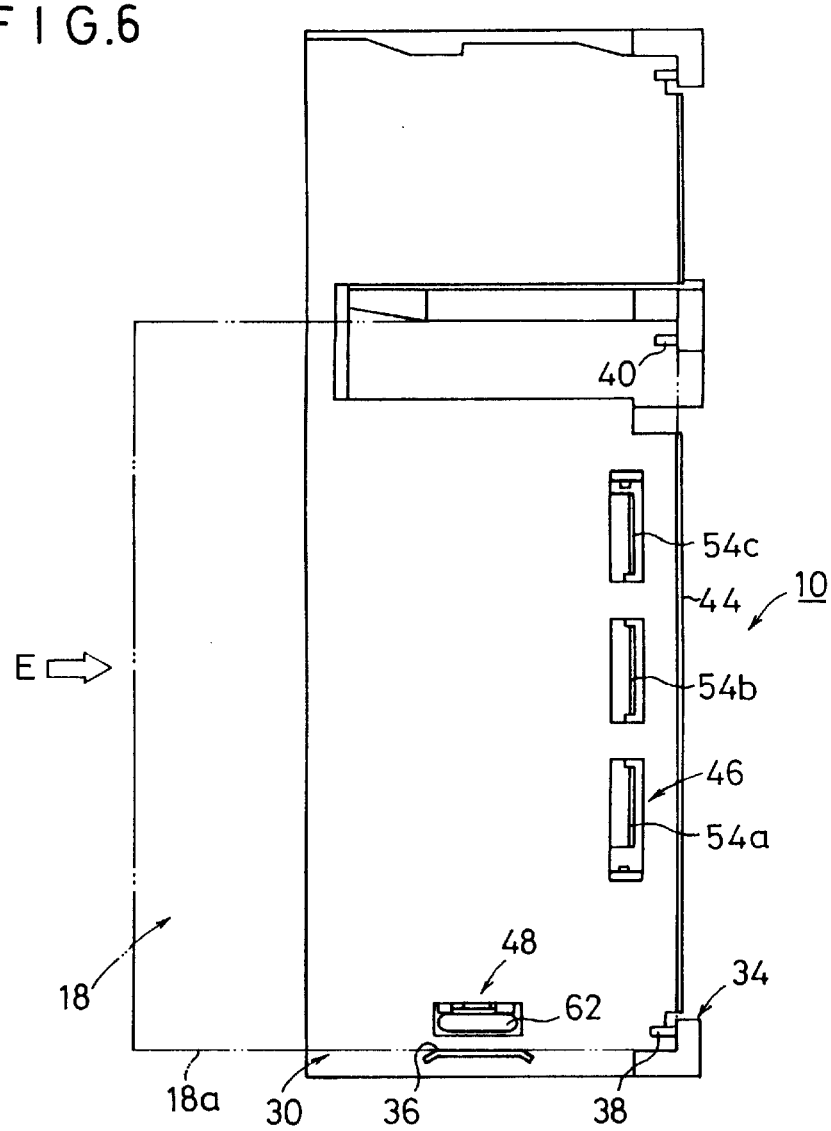
FIG. 6 is a plan view illustrative of the manner in which a cassette is properly inserted into a cassette loading unit.

The vertically movable frame 76 has a pair of side plates 100*a*, 100*b* spaced from each other by a certain distance in the direction indicated by the arrow F, which is perpendicular to the direction indicated by the arrow E. As shown in FIGS. 4 and 5, the moving means 94 has a first motor 102 fixedly mounted on the side plate 100*a* and having a drive shaft 102*a* to which a small-diameter pulley 104 is fixed. An endless belt 110 is trained around the small-diameter pulley 104 and a large-diameter pulley 108 which is fixed to an end of a drive shaft 106.

The drive shaft 106 is rotatably supported at its opposite ends on the side plates 100*a*, 100*b*. An arm 112 has an end secured to the large-diameter pulley 108 and an opposite end to which an end of a link 114 is swingably coupled. The link 114 has an opposite end supporting a first pivot shaft 116. An end of another arm 112 is secured directly to the other end of the drive shaft 106, and a link 114 with a first pivot shaft 116 is coupled to the other end of the other arm 112.

The side plates 100*a*, 100*b* each have two upper and lower guide grooves 120, 122 for moving the suction cups 90*a*, 90*b* along a path inclined obliquely downwardly toward the surface to be attracted of the stimulable phosphor sheet 22, which is opposite to the recording surface thereof. The guide grooves 120, 122 are shaped to provide the path for the suction cups 90*a*, 90*b*. A movable frame 124 has opposite ends to which the first pivot shafts 116 and second pivot shafts 126 are fixed, the first pivot shafts 116 being inserted in the respective guide grooves 120 and the second pivot shafts 126 in the respective guide grooves 122.

On the movable frame 124, there is mounted a guide plate 127 for forcibly opening the lid 28 of the cassette 18. The suction cups 90*a,* 90*b* are mounted on the movable frame 124 and spaced from each other by a distance corresponding to the dimension of a smallest stimulable phosphor sheet 22 in the direction indicated by the arrow F. All stimulable phosphor sheets 22 of different sets of dimensions that are introduced into the image information reading apparatus 12 are placed in relation to a reference position close to the side plate 100*a*. The feeding means 92 comprises a plurality of roller pairs 128 and a second motor 130 for rotating the roller pairs 128 in unison with each other.

As shown in FIG. 1, the image information reading apparatus 12 also has an erasure unit 138 and a reading unit 140 which are disposed in the apparatus housing 12*a* below the vertical sheet feeder 66 and connected to the vertical sheet feeder 66 through a feed system 136. The feed system 136 comprises a plurality of roller pairs 142 which jointly make up a vertical feed path extending downwardly from the vertical sheet feeder 66 and a horizontal feed path extending horizontally from the lower end of the vertical feed path. The reading unit 140 is positioned near the lower end of the vertical feed path and above the horizontal feed path.

The reading unit 140 comprises an auxiliary scanning feeding mechanism 144 for delivering a stimulable phosphor sheet 22 from a cassette 18 in an auxiliary scanning direction indicated by the arrow A, an optical system 146 for applying a laser beam L as it is deflected in a main scanning direction (substantially perpendicular to the auxiliary scanning direction) to the stimulable phosphor sheet 22 as it is delivered in the auxiliary canning direction, and a light guiding system 148 for photoelectrically reading light which is emitted from the stimulable phosphor sheet 22 when the stimulable phosphor sheet 22 is exposed to the laser beam L.

The auxiliary scanning feeding mechanism 144 has first and second roller pairs 150, 152 rotatable in synchronism with each other. Each of the first and second roller pairs 150, 152 has a pair of rollers that can be moved toward and away from each other. The light guiding system 148 comprises a light guide 154 extending along a main scanning line on the stimulable phosphor sheet 22 where the laser beam L is applied, and a photomultiplier 156 mounted on an upper end of the light guide 154.

A sheet feeder 158 for upwardly feeding the stimulable phosphor sheet 22 from which radiation image information has been read by the reading unit 140 is disposed downstream of the reading unit 140 in the direction of travel of the stimulable phosphor sheet 22 through the reading unit 140. When the stimulable phosphor sheet 22 is fed from the reading unit 140 upwardly by the sheet feeder 158, the leading end of the stimulable phosphor sheet 22 is guided horizontally over a power supply 160 above the erasure unit 138 via an erasing unit feeder 162 disposed near the power supply 160. The erasing unit feeder 162 then feeds back the stimulable phosphor sheet 22, whose leading end has been fed over the power supply 162, horizontally from the left to the right into the erasure unit 138.

The erasure unit 138 is disposed on one side of the feed path of the erasing unit feeder 162. The erasing unit 138 comprises a horizontal array of erasing light sources 164. The erasing unit feeder 162 extends horizontally through the erasure unit 138 and then upwardly obliquely, and is connected to the feed system 136.

Operation of the image information reading apparatus 12 in relation to the erroneous container insertion prevention structure 10 according to the first embodiment will be described below.

A cassette 18 which stores a stimulable phosphor sheet 22 which carries radiation image information of a subject such as a human body recorded by an exposure device (not shown) is introduced into the apparatus housing 12*a* along the support base 30 of the cassette loading region 20*a,* for example. As the cassette 18 is introduced, the leading end of the cassette 18 pushes open the shutter 32, and enters the interior space of the apparatus housing 12*a*.

Figure 7:
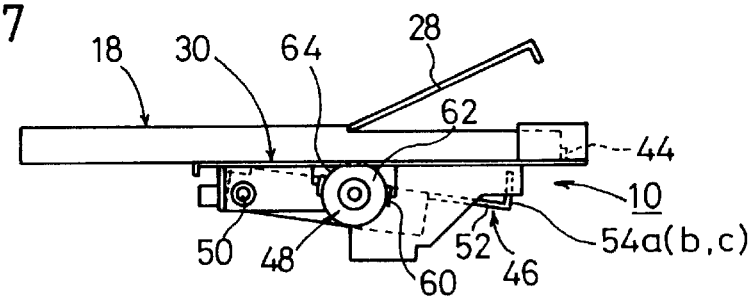
FIG. 7 is a side elevational view of the cassette loading unit shown in FIG. 6.

When the cassette 18 is inserted into one of the cassette loading units in the direction indicated by the arrow E such that a positioning reference surface 18*a* of the cassette 18 moves along the cassette insertion reference position 36, the cassette 18 engages the arcuate surface 64 of the cam 62, pushing the cam 62 downwardly to a position beneath the support base 30. As shown in FIG. 7, when the cam 62 is displaced through the opening 65 to the position beneath the support base 30, the swing member 52 fixed to the cam 62 by the joint plate 60 is angularly moved about the shaft 50 against the bias of the spring 58.

The engaging fingers 54*a*–54*c* integral with the distal end of the swing member 52 are retracted through the respective openings 56*a*–56*c* to the reverse side of the support base 30, and hence do not interfere with the cassette 18 as it is inserted. When the cassette 18 is inserted in the direction indicated by the arrow E until its leading end abuts against the positioning ledge 44, the cassette 18 is properly loaded in the cassette loading unit 20*a* (see FIG. 7).

Figure 8:
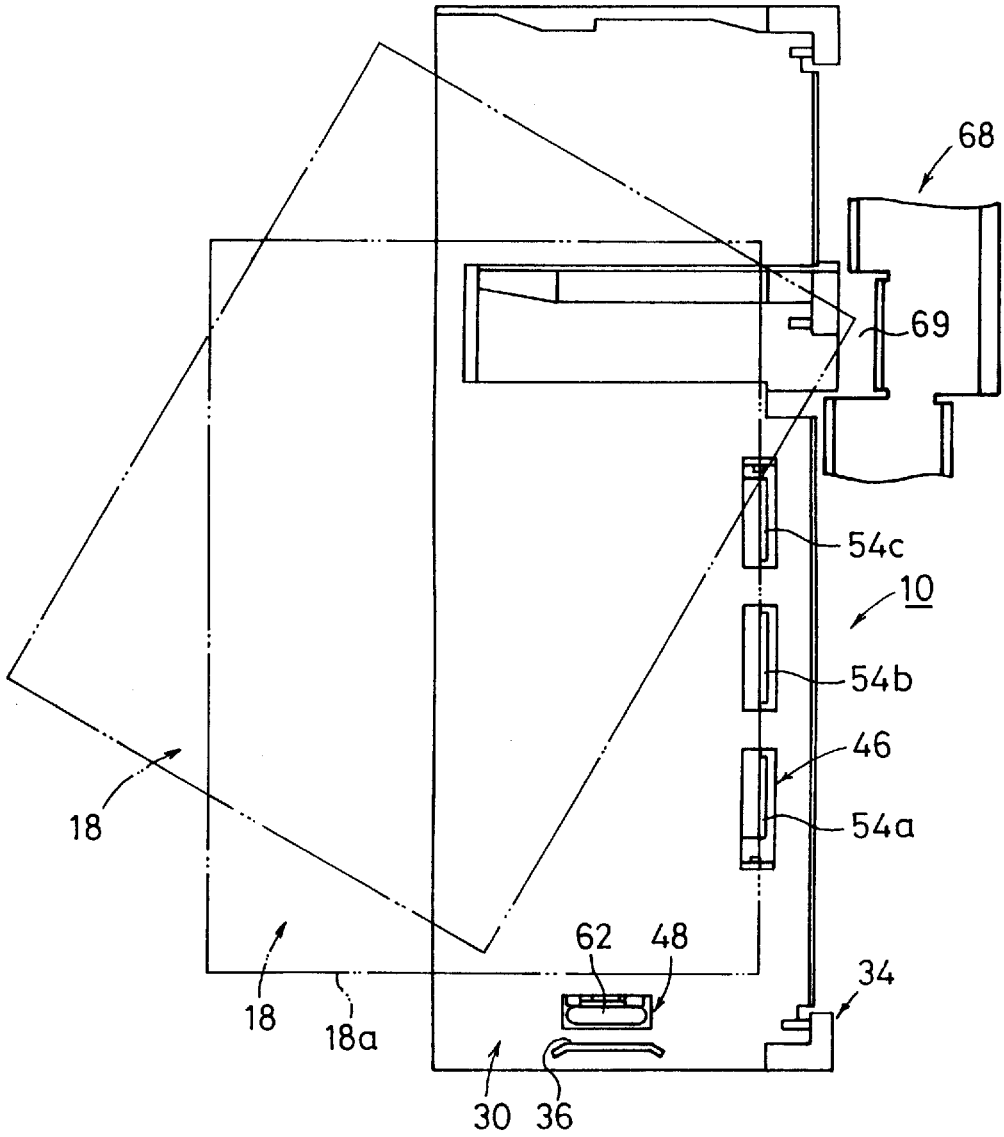
FIG. 8 is a plan view illustrative of the manner in which the cassette is inserted in error into the cassette loading unit.
Figure 9:
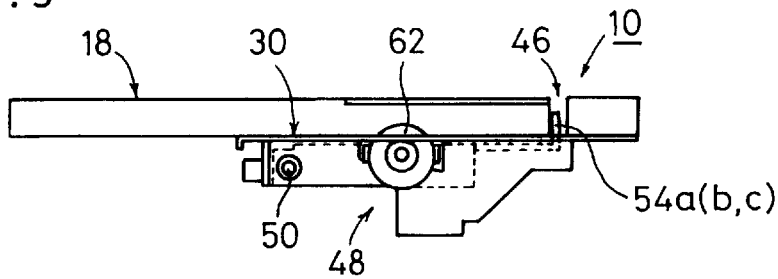
FIG. 9 is a side elevational view of the cassette loading unit shown in FIG. 8.

When the cassette 18 is inserted into one of the casette loading units with the positioning reference surface 18*a* spaced from the cassette insertion reference position 36, as shown in FIG. 8, the cassette 18 is inserted in the direction indicated by the arrow E at a position spaced from the cam 62. Therefore, the engaging fingers 54*a*–54*c* remain projecting upwardly through the respective openings 56*a*–56*c* in front of the positioning ledge 44, and hence the leading end of the cassette 18 is brought into engagement with the engaging fingers 54*a*–54*c* (see FIG. 9). Since the cassette 18 is prevented from being further inserted into the cassette loading unit 20*a* by the stopper means 46, the cassette 18 will not be inserted toward the vertical sheet feeder 66 beyond the positioning ledge 44 which provides a proper set position.

Consequently, the cassette 18 is prevented from engaging and damaging the sheet feeding mechanism 68 or the sheet feeding mechanism 68 is allowed to remove the stimulable phosphor sheet 22 reliably from the cassette 18. The cassette 18 can thus be inserted efficiently and accurately into the cassette loading unit. When the cassette 18 is inserted obliquely as shown in FIG. 8, the cassette 18 abuts against the engaging finger 54*c,* and is prevented from being further inserted. The sheet feeding mechanism 68 should preferably have a clearance 69 for avoiding contact with a corner of the cassette 18 thus inserted obliquely.

In the first embodiment, the releasing means 48 for retracting the stopper means 46 out of the path of the cassette 18 has the cam 62 fixed to the swing member 52 by the joint plate 60. Only when the cassette 18 is inserted along the cassette insertion reference position 36, the cassette 18 directly pushes the cam 62 to angularly displace the swing member 52 forcibly. The stopper means 46 and the releasing means 48 are highly simple in structure, and the stopper means 46 can accurately be actuated for effectively preventing the cassette 18 from being inserted in error.

After respective cassettes 18 have been inserted into the cassette loading units 20*a* through 20*d,* the lifting and lowering mechanism 70 of the vertical sheet feeder 66 is actuated to lift or lower the sheet feeding mechanism 68 into horizontal alignment with the cassette loading unit 20*a,* for example. More specifically, as shown in FIG. 4, the motor 78 mounted on the vertically movable frame 76 is energized to cause the belt and pulley means 80 and the gear assembly 82 to rotate the rotatable shaft 84 about its own axis in one direction. The pinions 86*a,* 86*b* mounted on the respective opposite ends of the rotatable shaft 84 in mesh with the racks 74*a,* 74*b* move in one of the directions indicated by the arrow D, i.e., either upwardly or downwardly, to bring the sheet feeding mechanism 68 mounted on the vertically movable frame 76 into horizontal alignment with the cassette loading unit 20*a.*

Then, the moving means 94 is actuated to displace the suction cups 90*a,* 90*b* into the cassette 18. Specifically, when the first motor 102 is energized, the small-diameter pulley 104 is rotated to cause the belt 110 to rotate the large-diameter pulley 108 and the drive shaft 106 in unison with each other in one direction. The arms 112 fixed to the large-diameter pulley 108 and the opposite end of the drive shaft 106 are angularly moved about the axis of the drive shaft 106. Since the first pivot shafts 116 are connected to the arms 112 by the links 114, and the first and second pivot shafts 116, 126 are mounted on the movable frame 124, the first and second pivot shafts 116, 126 move along the guide grooves 120, 122. The movable frame 124 displaces the suction cups 90*a,* 90*b* along the path inclined obliquely downwardly toward the surface, to be attracted, of the stimulable phosphor sheet 22 in the cassette 18.

Then, the suction cups 90*a,* 90*b* attract and hold the stimulable phosphor sheet 22, and the first motor 102 of the moving means 94 is reversed to turn the arms 112 to move the suction cups 90*a,* 90*b* in unison with the movable frame 124 from the cassette 18 toward the feeding means 92. The stimulable phosphor sheet 22 attracted by the suction cups 90*a,* 90*b* is now removed from the cassette 18 through the opening 26 thereof.

The leading end of the stimulable phosphor sheet 22 is then gripped by the roller pairs 128 of the feeding means 92. Since the roller pairs 128 have been rotated at a certain speed by the second motor 130, the stimulable phosphor sheet 22 is released from the suction cups 90*a,* 90*b* substantially at the same time that the leading end of the stimulable phosphor sheet 22 is gripped by the roller pairs 128. The stimulable phosphor sheet 22 is transferred from the roller pairs 128 to the feed system 136, and then fed downwardly to the reading unit 140 by the roller pairs 142 of the feed system 136.

In the reading unit 140, while the stimulable phosphor sheet 22 is being fed in the auxiliary scanning direction indicated by the arrow A by the first and second roller pairs 150, 152 of the auxiliary scanning feeding mechanism 144, the laser beam L emitted from the optical system 146 is applied to the recording surface of the stimulable phosphor sheet 22. Radiation image information stored in the stimulable phosphor sheet 22 is now photoelectrically read by the light guiding system 148.

After the stored radiation image information has been read, the stimulable phosphor sheet 22 is fed vertically upwardly by the sheet feeder 158, and transferred from the sheet feeder 158 to the erasing unit feeder 162 with the leading end being guided horizontally above the power supply 160. In the erasing unit feeder 162, the stimulable phosphor sheet 22 is fed horizontally with its trailing end as fed by the sheet feeder 158 serving as the leading end. The erasure unit 138 erases remaining radiation image information from the stimulable phosphor sheet 22 with the erasing light sources 164. Thereafter, the stimulable phosphor sheet 22 is fed to the feed system 136, and then fed upwardly by the feed system 136, after which the stimulable phosphor sheet 22 is sent back into the empty cassette 18 in the cassette loading unit 20*a* by the vertical sheet feeder 66.

Figure 10:
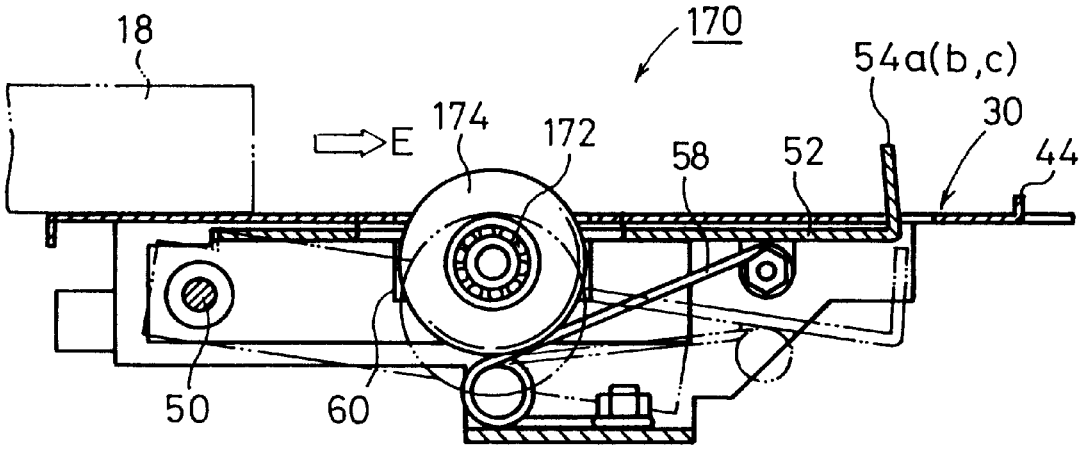
FIG. 10 is a side elevational view, partly in cross section, of an erroneous container insertion prevention structure according to a second embodiment of the present invention.

FIG. 10 shows an erroneous container insertion prevention structure 170 according to a second embodiment of the present invention. Those parts of the erroneous container insertion prevention structure 170 which are identical to those of the erroneous container insertion prevention structure 10 according to the first embodiment are denoted by identical reference characters, and will not be described in detail below.

The erroneous container insertion prevention structure 170 has a roll (cam) 174, instead of the cam 62, rotatably supported on the end of the joint plate 60 by a bearing 172. When the cassette 18 is inserted along the cassette insertion reference position, the cassette 18 engages the roll 174 and turns the roll 174 downwardly to a position beneath the support base 30 as indicated by the two-dot-and-dash line in FIG. 10. Since the roll 174 is rotatable by the bearing 172, the roll 174 and the cassette 18 are effectively prevented from wearing due to frictional engagement between the roll 174 and the cassette 18.

Figure 11:
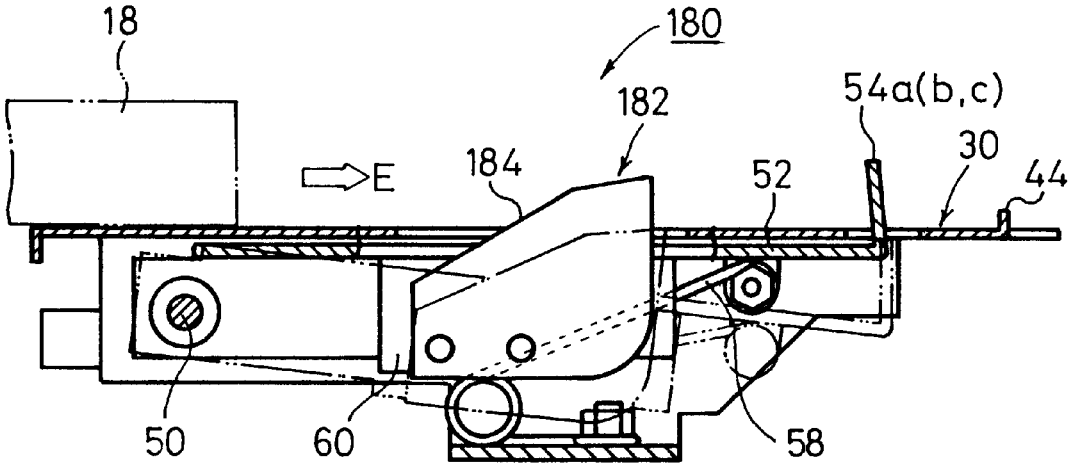
FIG. 11 is a side elevational view, partly in cross section, of an erroneous container insertion prevention structure according to a third embodiment of the present invention.

FIG. 11 shows an erroneous container insertion prevention structure 180 according to a third embodiment of the present invention. Those parts of the erroneous container insertion prevention structure 180 which are identical to those of the erroneous container insertion prevention structure 10 according to the first embodiment are denoted by identical reference characters, and will not be described in detail below.

The erroneous container insertion prevention structure 180 has a substantially rectangular cam 182, instead of the cam 62, having an inclined surface 184 which is inclined upwardly in the direction in which the cassette 18 is inserted. When the inserted cassette 18 engages the cam 182, the cassette 18 slides on the inclined surface 184 for smoothly and reliably pushing the cam 182 downwardly toward the reverse side of the support base 30.

With the erroneous container insertion prevention structure according the present invention, only when the container is inserted along the container insertion reference position, the releasing means is operated to retract the stopper means out of the path of the container, allowing the container to be placed in a desired set position in the loading unit. If the container is inserted so as to be spaced from or inclined with respect to the container insertion reference position, then the container is engaged by the stopper means which is positioned upstream of the positioned where the leading end of the container is to be positioned. The container can thus be loaded smoothly and reliably. The stopper means and the releasing means are simple in structure, and the stopper means can reliably be actuated depending on how the container is inserted.

Furthermore, the container is prevented from being inserted in error into interference with the internal mechanism, resulting in a failure to damage the sheet feeder or a failure to remove the sheet-like member from the container. Therefore, the container can reliably be loaded in place and the sheet-like member in the container can desirably be processed efficiently.

Although certain preferred embodiments of the present invention have been shown and described in detail, it should be understood that various changes and modifications may be made therein without departing from the scope of the appended claims.

What is claimed is:

1. A structure for preventing a container which stores a sheet-like member from being removably inserted in error into a loading unit, comprising:

stopper means disposed upstream of a position for positioning a leading end of the container on said loading unit with respect to a direction in which the container is inserted, for engaging the leading end of the container to prevent the container from being inserted; and releasing means disposed at a container insertion reference position in the said loading unit, for engaging the container to retract said stopper means out of a path of said container only when said container is inserted along said container insertion reference position.

2. A structure according to claim 1, wherein said stopper means comprises:

a swing member; and engaging fingers mounted on a distal end of said swing member for movement into the path of said container for engaging the leading end of said container;

said releasing means having a cam mounted on said swing member for swinging movement in unison with said swing member to retract said engaging fingers out of path of said container upon insertion of said container along said container insertion reference position.

3. A structure according to claim 2, further comprising:

a support base for supporting said container thereon, said swing member being angularly movably mounted on a reverse side of said support base; and a spring for biasing said swing member toward said support base, said support base having openings defined therein for passing said engaging fingers respectively therethrough.

4. A structure according to claim 2, wherein said cam has an arcuate surface on at least a portion thereof for being contacted by said cassette.

5. A structure according to claim 2, wherein said cam comprises a roll rotatable by a bearing rotatably supported on a support base.

6. A structure according to claim 2, wherein said cam comprises a substantially rectangular member having an inclined surface inclined upwardly in the direction in which said cassette is inserted.

7. A container processing apparatus comprising:

a structure for preventing a container which stores a sheet-like member from being removably inserted in error into a loading unit;

a sheet feeder for taking said sheet-like member from said container inserted in said loading unit;

said structure comprising:

stopper means disposed upstream of a position for positioning a leading end of the container on said loading unit with respect to a direction in which the container is inserted, for engaging the leading end of the container to prevent the container from being inserted toward said sheet feeder; and releasing means disposed at a container insertion reference position in the said loading unit, for engaging the container to retract said stopper means out of a path of said container only when said container is inserted along said container insertion reference position.

8. A container processing apparatus according to claim 7, wherein said stopper means comprises:

a swing member; and engaging fingers mounted on a distal end of said swing member for movement into the path of said container for engaging the leading end of said container;

said releasing means having a cam mounted on said swing member for swinging movement in unison with said swing member to retract said engaging fingers out of path of said container upon insertion of said container along said container insertion reference position.

9. A container processing apparatus according to claim 8, further comprising:

a support base for supporting said container thereon, said swing member being angularly movably mounted on a reverse side of said support base; and a spring for biasing said swing member toward said support base, said support base having openings defined therein for passing said engaging fingers respectively therethrough.

10. A container processing apparatus according to claim 8, wherein said cam has an arcuate surface on at least a portion thereof for being contacted by said cassette.

11. A container processing apparatus according to claim 8, wherein said cam comprises a roll rotatable by a bearing rotatably supported on a support base.

12. A container processing apparatus according to claim 8, wherein said cam comprises a substantially rectangular member having an inclined surface inclined upwardly In the direction in which said cassette is inserted.

* * * * *